US006877734B2

(12) United States Patent
Muratani

(10) Patent No.: US 6,877,734 B2
(45) Date of Patent: Apr. 12, 2005

(54) SHEET FEEDING DEVICE, SHEET FEEDING METHOD AND IMAGE FORMING APPARATUS

(75) Inventor: Masataka Muratani, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 75 days.

(21) Appl. No.: 10/301,666

(22) Filed: Nov. 22, 2002

(65) Prior Publication Data

US 2004/0100012 A1 May 27, 2004

(51) Int. Cl.[7] ..... B65H 3/14
(52) U.S. Cl. ..... 271/97; 271/113; 271/127
(58) Field of Search ..... 271/97, 113, 127, 271/9.01, 11

(56) References Cited

U.S. PATENT DOCUMENTS 4,966,356 A * 10/1990 Ohyabu et al. ..... 271/9.11
5,893,554 A 4/1999 Okahashi et al.
5,931,455 A * 8/1999 Okui et al. ..... 271/127
6,015,144 A * 1/2000 Yoshii et al. ..... 271/97
6,039,315 A * 3/2000 Lim ..... 271/160
6,354,585 B1 * 3/2002 Takahashi ..... 271/97

FOREIGN PATENT DOCUMENTS

JP 3-211136 A * 9/1991
JP 4-23747 A * 1/1992
JP 6-271127 A 9/1994
JP 8-020451 A 1/1996
JP 10-087096 A 4/1998

* cited by examiner

*Primary Examiner*—David H. Bollinger
(74) *Attorney, Agent, or Firm*—Foley & Lardner LLP

(57) ABSTRACT

The paper feeder of the present invention includes paper supply cassettes to house sheets of paper; friction paper pickup rollers to take out sheets of paper one by one by contacting a paper placed at the top of paper in the paper supply cassettes; openings formed on the paper supply cassettes to pass the air to the side of the paper at the downstream position from the friction pickup rollers; and air blowing mechanisms to blow the air into the openings. This paper feeder is used for supplying paper for an image forming apparatus.

10 Claims, 5 Drawing Sheets

SHEET FEEDING DEVICE, SHEET FEEDING METHOD AND IMAGE FORMING APPARATUS

BACKGROUND OF THE INVENTION

1. Field of the Invention

The present invention relates to a paper feeder and a paper feeding method for taking paper for use in electrophotographic apparatus, printers and the like one by one surely and feeding them in a prescribed direction and an image forming apparatus.

2. Description of the Related Art

As a paper feeder used in an image forming apparatus, a paper feeder adopting a friction paper feeding system is now broadly put in practical use. This paper feeder takes out sheets of paper housed in paper supply cassettes according to the friction paper supply system using, for example, pickup rollers and taken out sheets of paper are separated one by one according to a friction separating system, that is, using a separation pad or a separation roller and sent out in an image forming direction.

In order to prevent adherence of sheets of paper in such a paper feeder, i.e., to prevent a plurality of adhered sheets from being supplied at one time, a device has been developed which prevents a supply of sheets of paper from adhering closely to each other by blowing an air stream into the end surface of sheets of paper in a paper supply cassette as disclosed in Japanese Patent Application No. 6-271127.

However, the above-mentioned conventional paper feeder is in a structure to blow an air stream between sheets of paper in the paper supply cassette and therefore, the air stream acts only on the leading edge of sheets of paper in the conveying direction and in the case of ordinary paper that are not so highly adhesive, supply of plural sheets is prevented but in the case of paper that are high adhesive, it becomes difficult to separate them because of high adhesion and take-out of sheets of paper is impeded. When an air stream is blown between sheets of paper in the paper supply cassette, a clearance is produced between a paper placed at the top position and a paper thereunder and a friction paper supply force of pickup roller acting on the top paper escapes. This is considered to be one of reasons for causing the above-mentioned trouble.

In recent years, when glossy paper coated with thin resin on both sides and extremely high adhesive is supplied to color copiers, the separation resisting force caused by the close adhesion generated on the overall surface of the glassy paper becomes stronger than the friction paper supply force of the pickup rollers made it difficult to separate sheets of paper and take out them. This phenomenon becomes remarkable especially in large size paper and actually, it becomes necessary to restrict size or kind of sheets of paper that are used in a paper feeder and functions of a paper feeder or an image forming apparatus is impaired and furthermore, reliability of an image forming apparatus requiring paper supply is also impaired.

Accordingly, when supplying sheets of paper that are extremely adhesive using the friction paper supply system, a certain paper supply is demanded regardless of size or kind of paper and it is desired to obtain a highly functional and reliable paper feeder, a paper feeding method and an image forming apparatus.

SUMMARY OF THE INVENTION

It is an object of the present invention to supply sheets of paper by surely taking out them one by one by making it easy to separate highly adhesive paper regardless of size and kind of paper by relieving adhesion between sheets of paper in a paper feeder without reducing paper supply according to a friction paper feed system.

According to preferred embodiments of the present invention, there is provided a paper feeder, comprising: paper supply cassettes to house sheets of paper; friction paper pickup rollers to contact and take out a paper placed on the top position in paper supply cassettes in a prescribed direction; and an air blowing mechanism to blow an air stream into an upstream area from the friction paper pickup roller from the side of the sheets of paper.

Further, according to the embodiments of the present invention, there is provided a paper feeder, comprising: paper supply cassettes to house sheets of paper; pickup rollers to contact and take out a paper placed on the top position in the paper supply cassette in a prescribed direction; and an air blowing mechanism to blow the air stream into the upstream area from the pickup roller of the sheets of paper housed in the paper supply cassette.

Further, according to the embodiments of the present invention, there is provided a paper supply method, comprising the steps of: taking out a paper placed on the top position in a prescribed direction by bringing a friction paper pickup roller in contact with paper in the paper supply cassette; and blowing air into an area at the upstream of the friction paper pickup roller of the paper housed in the paper supply cassette.

Further, according to the embodiments of the present invention, there is provided an image forming apparatus comprising: paper supply cassettes provided in the main body of the apparatus to house sheets of paper; pickup rollers to contact the paper housed in the paper supply cassettes and take out the paper in a prescribed direction; a blowing mechanism to blow air into an area at the upstream side from the pickup rollers of the paper housed in the paper supply cassettes from the side; and image forming mechanisms provided in the main body of the apparatus to form images on the paper taken out by the pickup rollers.

DETAILED DESCRIPTION OF THE EMBODIMENTS

Preferred embodiments of the present invention will be explained in detail referring to the attached drawings.

Figure 1:
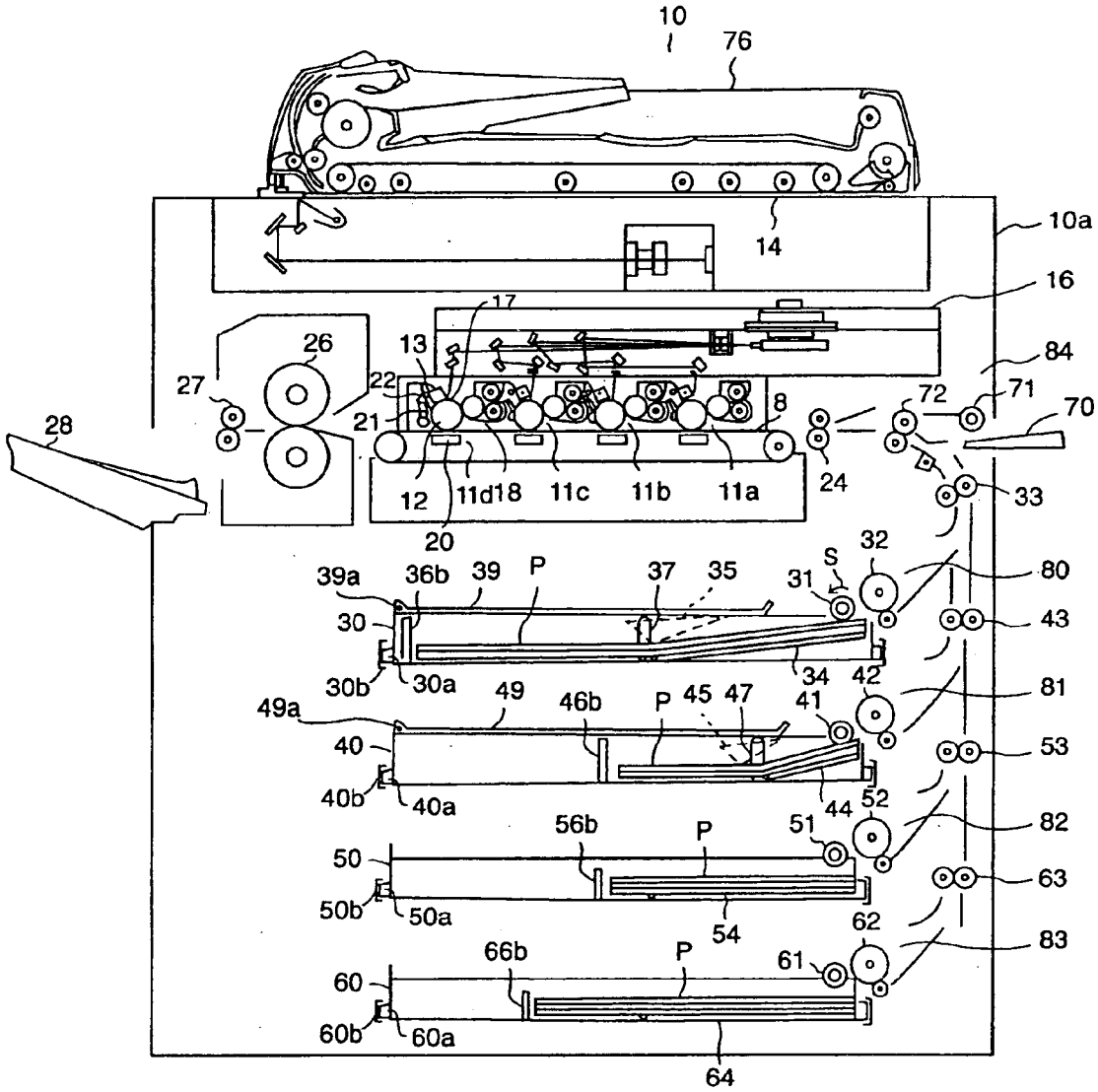
FIG. 1 is a schematic diagram showing the structure of an image forming apparatus in a first embodiment of the present invention.

FIG. 1 is a schematic structure diagram showing an image forming apparatus in a first embodiment of the present invention. Four sets of image forming mechanisms 11*a*–11*d* arranged along a conveyor belt 8, a main body 10 of a four-tandem color copier to obtain color images, and an automatic document feeder 76 are shown.

Each of the image forming mechanisms 11*a*–11*d* is composed of a main charger 13, an exposing unit 17 of an exposure device 16 to expose a document on a document feeding table 14, a developing unit 18, a transferring/separation charger 20, a cleaner 21 and a charge eliminating lamp 22 arranged around each photosensitive drum 12 in its rotating direction. Further, each of the developing units 18 of the image forming mechanisms 11*a*–11*d* develops images with two-component developing agent comprising yellow (Y), magenta (M), cyan (C) or black (BK) toner and carrier.

Under the main body 10 of the apparatus, first-fourth paper supply cassettes 30, 40, 50, 60 that are paper containing members to house sheets of paper P that are supplied to the image forming mechanisms 11*a*–11*d* are mounted detachably. At the right side to the main body 10, a manual tray 70 is provided for manually supplying paper P. Rails 30*a*, 40*a*, 50*a*, 60*a* formed on the sides of the paper cassettes 30, 40, 50, 60 are guided by guides 30*b*, 40*b*, 50*b*, 60*b* provided on the housing 10*a* of the main body 10 so that they can be pulled out from the main body 10 or housed therein.

At the upper stream side from the conveyor belt 8, there are provided first-fourth paper supply mechanisms 80–83 to take out paper P from the first-fourth paper supply cassettes 30, 40, 50, 60, a manual paper supply mechanism 84 to take out paper P from the manual tray 70, first-fourth transferring rollers 33, 43, 53, 63 and an aligning roller 24. At the downstream side from the conveyor belt 8, there are provided a fixing roller 26, a paper-discharging roller 27 and a paper-receiving tray 28. Further, a numeral 76 denotes an automatic document feeder to supply a document to the document-feeding table 14.

Next, a paper feeder to supply paper P from the first-fourth paper supply cassettes 30, 40, 50, 60 to the image forming mechanisms 11*a*–11*d* will be described in detail. The first paper supply cassette 30 at the first stage out of the first-fourth paper supply cassettes is capable of supplying mainly the maximum 400 mm long A3 size paper out of glossy paper with both sides coated by resin for use by color copiers. The second paper supply cassette 40 at the second stage supplies mainly post card size to A4 size paper out of glossy paper coated with thin resin at both sides. The third paper supply cassette 50 and the fourth paper supply cassette 60 at the third and fourth stages are for supplying ordinary paper.

Figure 2:
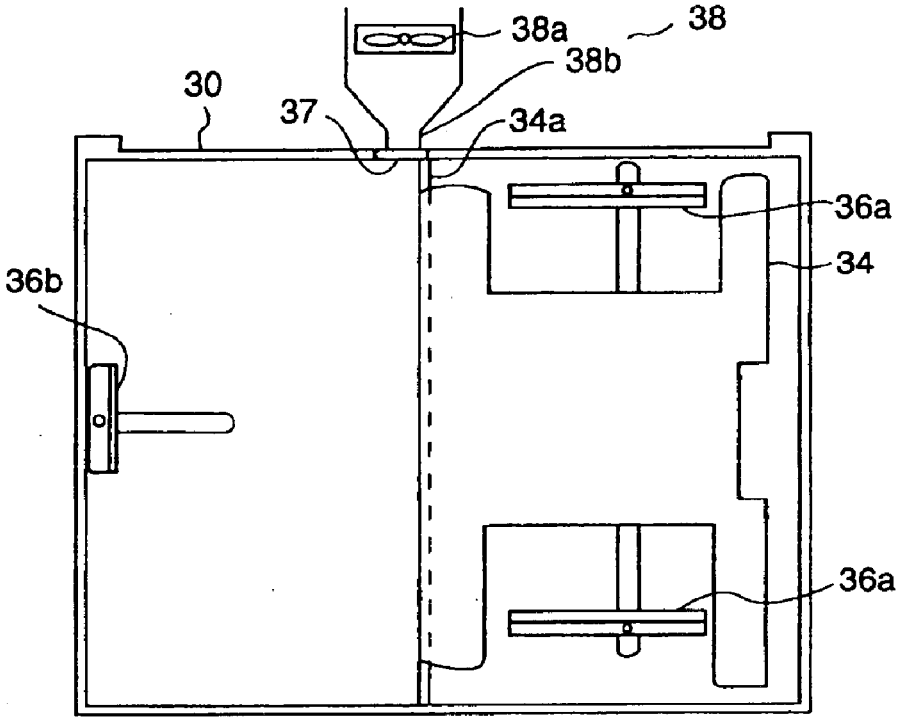
FIG. 2 is a schematic plan view of a first paper supply cassette in the first embodiment of the present invention.
Figure 3:
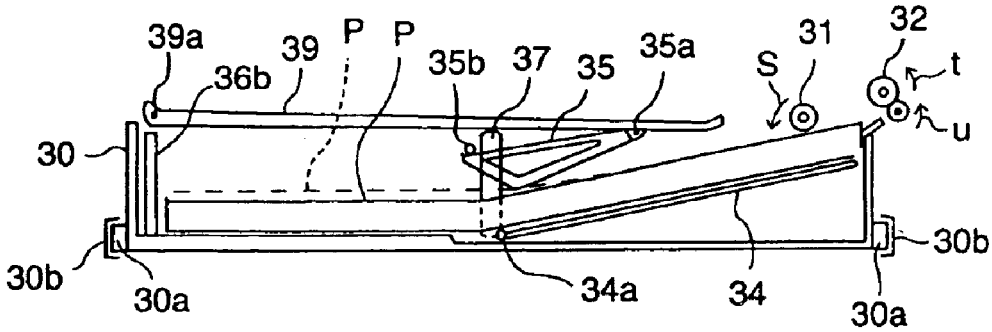
FIG. 3 is a schematic side view of the first paper supply cassette in the first embodiment of the present invention.

At the bottom of the first paper supply cassette 30 shown in FIG. 2 and FIG. 3, there is provided a first paper supply tray 34 for oscillating and supporting the leading edges of paper P in the take-out direction. The first paper supply tray 34 pushes up paper P and is rotated by an elevating means (not illustrated) at the position of about 200 mm from the leading edge of paper P in the take-out direction, equivalent to almost the center of a 400 mm longest paper size as the first supporting point 34*a*. The first paper supply tray 34 is rotated corresponding to the remaining amount of paper P by an elevating means (not illustrated). When the first paper supply tray 34 is rotated, a paper P is bent at the first supporting point 34*a* of the first paper supply tray 34 in the first paper supply cassette 30 as shown in FIG. 3. 36*a* is a width control plate that is able to slide according to a paper width so as to control both sides of a paper P and 36*b* is a trailing edge control plate that is able to slide according to a length of paper so as to control the trailing edge of a paper P.

On the side of the first paper supply cassette 30 near the first supporting point 34*a*, a first blowing port 37 that is an opening is formed. A paper P is somewhat bent with the slope of the first paper supply tray 34 at a point near the first blowing port 37. A first fan 38*a* for taking air and a first flowing mechanism that has a first duct 38*b* for sending the air stream generated by the first fan 38*a* to the first blowing port 37 are provided near the first blowing port 37 of the first paper supply cassette 30. The air sent by the first blowing mechanism 38 enters between sheets of paper P from a bent area of the paper P through the first blowing port 37.

On the top surface of the first paper supply cassette 30, a cover 39 for covering the rear portion of the paper supply cassette 30 is provided. This cover 39 can be opened/closed at a supporting point 39*a*. The cover 39 is provided with a first limiting arm 35 that is a limiting member placed on a paper P by own weight at a mounting shaft 35*a* as a supporting point. The limiting arm 35 prevents a paper P from rising up excessively by the air from the first blowing mechanism 38. 35*b* is a stopper that controls the rotation of the first limiting arm 35.

Figure 4:
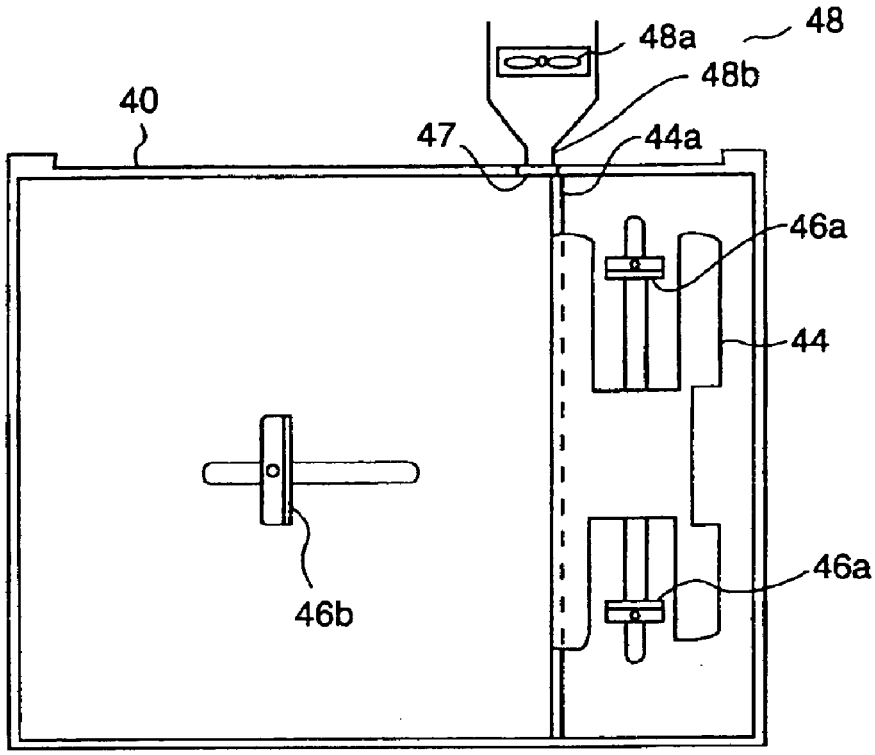
FIG. 4 is a schematic plan view of a second paper supply cassette in the first embodiment of the present invention.
Figure 5:
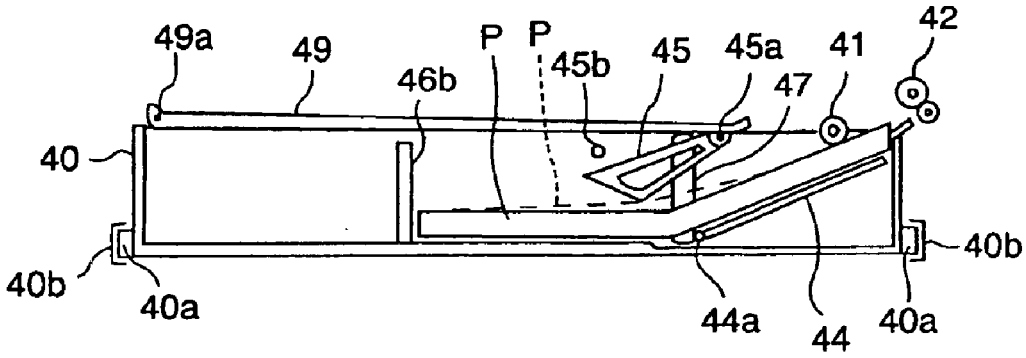
FIG. 5 is a schematic side view of the second paper supply cassette in the first embodiment of the present invention.

On the bottom surface of the second paper supply cassette 40 shown in FIG. 4 and FIG. 5, there is provided a second paper supply tray 44 to support the leading edge of a paper P in the take-out direction at a position about 100 mm away from the leading edge of a paper P in the take-out direction as a second supporting point 44*a*. The second paper supply tray 44 pushes up a paper P and is rotated by an elevating means (not illustrated) likewise the first paper supply tray 34. A numeral 46*a* denotes a width control plate that is able to slide according to a paper width so as to control both sides of a paper P and 46*b* is a trailing edge control plate that is able to slide according to a paper length so as to control the trailing edge of a paper P.

On the side of the second paper supply cassette 40 near the second supporting point 44*a*, a second blowing port 47 is provided, which is an opening. At a point near the second blowing port 47, a paper P is somewhat bent with the slope of the second paper supply tray 44. The air generated by a second blowing mechanism 48 that has a second fan 48*a* and a second duct 48*b* is blown into the second blowing port 47 and enters between sheets of paper P from the bent area of the paper P.

On the top surface of the second paper supply cassette 40, a cover unit 49 that can be opened/closed at a supporting point 49*a* is mounted likewise the first paper supply cassette 30. The cover unit 49 is provided with a second limiting arm 45 that prevents a paper P from rising up excessively by rotating at a mounting shaft 45*a* as a supporting point. A numeral 45*b* shows a stopper.

The third and fourth paper supply cassettes 50 and 60 are for supplying ordinary paper and therefore, are not provided with an air blasting port or a ventilation mechanism although the third and fourth paper supply trays 54 and 64, a width control plate (not illustrated) and trailing edge control plates 56*b*, 66*b* are provided.

Next, the first-fourth paper supply mechanisms 80–83 and the manual paper supply mechanism 84 of the paper feeder are provided with first-fourth pickup rollers 31, 41, 51, 61 and manual pickup roller 71 that are friction paper supply members to take out paper P from the paper supply cassettes 30, 40, 50, 60 and the manual tray 70, and are also provided with first-fourth separation roller pairs 32, 42, 52, 62 and a manual separation roller pair 72. The first-fourth paper supply mechanisms 80–83 and the manual paper supply mechanism 84 are turned ON/OFF to drive by a paper supply clutch (not illustrated) so as to operate only when supplying paper.

Figure 6:
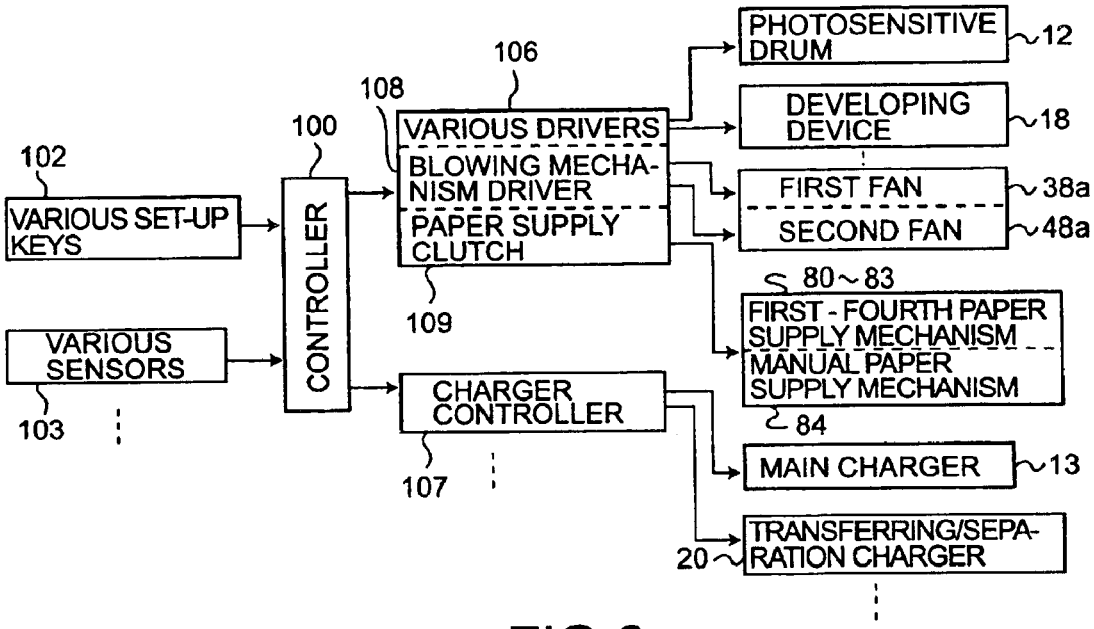
FIG. 6 is a block diagram showing a control system of the main body of the apparatus in the first embodiment of the present invention.

FIG. 6 is a block diagram showing the control system of the main body 10 of the color image forming apparatus. At the input side of a controller 100, various setup keys 102 (not illustrated) for setting kinds of paper and image conditions and various switches/sensors 103 such as a paper sensing switch (not illustrated) in the paper conveying path, toner density sensor (not illustrated) and the like on an operation panel are connected.

At the output side of the controller 100, various drivers 106 for controlling such driving devices as the photosensitive drums 12, the developing devices 18 and the like, a charger controller 107 for controlling applied voltage to the main charger 13, the transferring/separation charger 20 and the like by controlling a high voltage power source are connected. The various drivers 106 include a blowing mechanism 108 to control the first and second fans 38*a* and 48*a*, and a paper supply clutch 109 to turn ON/OFF the driving force of a main motor (not illustrated) transmitted to the first-fourth paper supply mechanism 80–83 or the manual paper supply mechanism 84.

Next, actions of the paper feeder will be described. The first paper supply cassette 30 houses A3 size glossy paper for color copiers and the second paper supply cassette houses A4 size glossy paper for color copier. The third paper supply cassette 50 and the fourth paper supply cassette 60 store A4 size and A3 size ordinary paper, respectively.

At the time to start the A3 size color image formation, when a document is set on the automatic document feeder 76, copy conditions are input through the operation panel (not illustrated) and when the copy button (not illustrated) is turned ON, the copying starts. As a paper size is A3, the blowing mechanism driver 108 drives the first fan 38*a* of the first blowing mechanism 38, and air is blown into the first paper supply cassette 30 through the first duct 38*b*. The air enters between sheets of paper within a range controlled by the first limiting arm 35 in the first paper supply cassette 30. The adhesion between paper P is relieved, a paper P rises up as shown by the dotted line in FIG. 3 and the top positioned paper P is separated and becomes the easily taken out state. Further, the first paper supply mechanism 80 is turned ON by the paper supply clutch (not illustrated) and driven by the main motor.

Further, the strength of the air blown into the first paper supply cassette 30 is regulated to such a level that the air does not enter between sheets of paper P at the paper supply position by the pickup rollers.

Further, the automatic document feeder 76 and the image forming mechanisms 11*a*–11*d* are driven, each of the photosensitive drums 12 is rotated jointly with the beam scanning by the exposure device, and the image forming process is carried out in order. The photosensitive drums 12 are charged by the main charger 13, applied with image beams to yellow, magenta, cyan and black toners and electrostatic latent images are formed, respectively. Further, the images formed on the photosensitive drums 12 are developed by the developing devices 18 and after toner images in respective colors are formed, the toner images are transferred in order on a paper P running on the conveyor belt 8.

On the other hand, while toner images in respective colors are being formed on the photosensitive drums 12, air is blown between sheets of paper P by the blowing mechanism 38 in the first paper supply cassette 30. As sheets of paper P are in the state easily separable one by one and taken out easily from the first paper supply cassette 30, a paper P at the top position is easily taken out by the friction paper supply force of the pickup roller 31 that is rotating in the arrow direction s. Then, separated from the second and subsequent paper P easily by the friction separating force of the separation rollers 32 that are rotating in the arrow directions t and u, the paper P is sent out in the direction of the first conveying rollers 33. At this time, at the position of the pickup roller 31 of the end of the paper take-out direction of the first paper supply cassette 30, air did not enter between sheets of paper P. Therefore, the friction paper supply force of the pickup roller 31 certainly acts on a paper P at the top position.

Thereafter, the paper P is once stopped at the position of the aligning roller 24, sent to the transferring position of the conveyor belt 8 synchronizing with toner images on the photosensitive drums 12 and yellow, magenta, Cyan and black toner images are multi-transferred on the paper P in order. Thereafter, the paper P is separated from the conveyor belt 8, conveyed to the fixing roller 26. Then, after the toner images are heated and fixed to a full-color image and discharged on the paper-receiving tray 28 by the discharging roller 27.

After transferring toner images, the image forming mechanisms 11*a*–11*d* stand for the next image forming after the operations of the cleaner 21 and the charge eliminating lamp 22. Then, repeating the above-mentioned image forming operations until the number of required sheets of paper is reached. When a prescribed number of sheets is reached, the image forming operation is stopped. The paper supply clutch (not illustrated) of the first paper supply mechanism 80 is turned OFF, the first fan 38*a* of the first blowing mechanism 39 is stopped and the apparatus stands for the next image forming operation.

Next, when executing the A4 size color image forming operation, the blowing mechanism driver 108 drives the second fan 48*a* of the second blowing mechanism 48 and air is blown into the second paper supply cassette 40 through the second blowing port 47. The air enters between paper P in the second paper supply cassette and adherence between sheets of paper P is relieved and it becomes easy to separate a paper P at the top position and take out the paper. All others are same as the A3 size color image forming operation.

Further, when executing the paper color image forming operation or the single color image forming operation on ordinary paper, feed sheets of paper from the third or fourth paper supply cassette 50 or 60 by the third or the fourth paper supply mechanism 82 or 83. Further, when necessary, feed sheets of paper from the manual tray 70 by the fifth paper supply mechanism 84.

According to the first embodiment, when feeding highly adhesive glossy paper for color copiers from the first and second paper supply cassettes 30, 40, it is possible to relieve adhesion between sheets of paper and promote separation of sheets of paper P by blowing air between sheets of paper in the bundle state in the first or second paper supply cassette 30 or 40 through the first or second blowing port by the first or second blowing mechanism 38 or 48. Furthermore, as a paper P is somewhat bent near the blowing ports 37, 47, the air enters between them easily and adhesion can be reduced more effectively.

Further, as the strength of air blown by the first or second blowing mechanism 38 or 48 is regulated so that the air does not enter between sheets of paper at the pickup rollers 31, 41, a paper P at the top position is certainly supported by its lower paper and the friction paper supply force by the pickup rollers 31, 41 does not become weak and acts on a paper P at the top position certainly. Further, the paper supply cassettes 30 and 40 are covered by the cover units 39 and 49, the rising of paper P by the air can be controlled by the first or second limiting arm 35 or 45 and paper P can be satisfactorily supplied by friction without impeding the friction paper supply force of the pickup rollers 31, 41 by flutter of a paper P in the paper supply cassettes 30, 40 or contact of paper P to peripheral equipment.

Thus, the air separation by the blowing mechanisms 38, 48 supports the friction paper supply force of the pickup rollers 31, 41 and it becomes possible to easily and certainly supply a paper P at the top position in the paper supply cassettes 30, 40. Accordingly, various kinds of sheets of paper P can be supplied certainly without restricting size or kind of paper P that is used in the paper supply cassettes 30, 40. Particularly, a largest A3 size glossy paper for color copiers can be supplied from the first paper supply cassette 30 and a highly functional and reliable image forming apparatus is obtained.

Figure 7:
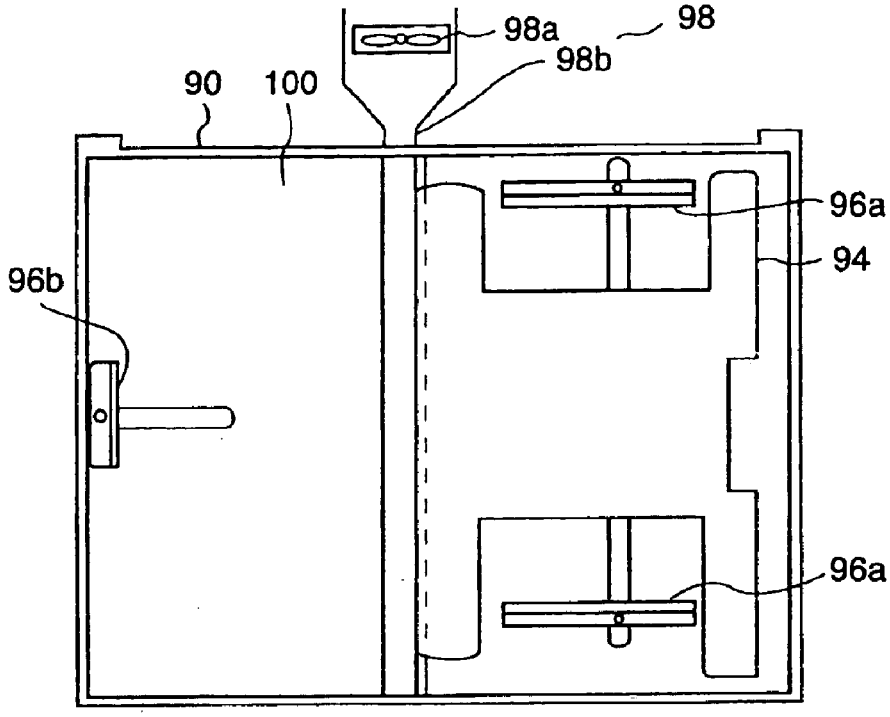
FIG. 7 is a schematic plan view of a fifth paper supply cassette in the second embodiment of the present invention.
Figure 8:
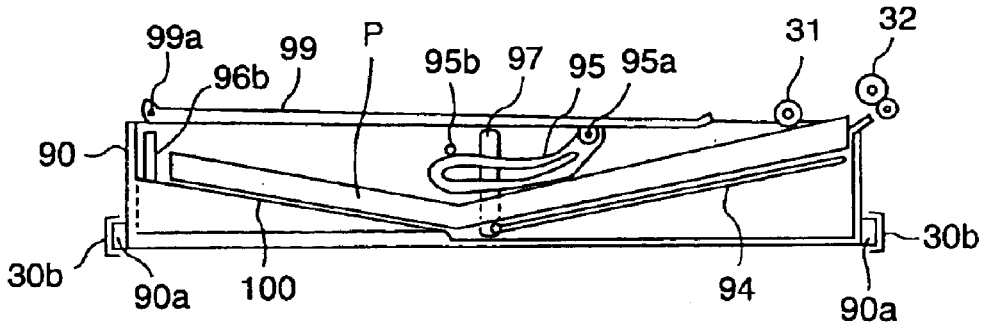
FIG. 8 is a schematic side view of the fifth paper supply cassette in the second embodiment of the present invention.

Next, the second embodiment of the present invention will be described. This second embodiment differs from the first embodiment in the bottom shape of the first paper supply cassette. In this second embodiment, therefore, the same component elements explained in the first embodiment will be assigned with the same reference numerals and the detailed explanation thereof will be omitted. The fifth paper supply cassette 90 shown in FIG. 7 and FIG. 8 can be pulled out of or housed in the main body 10*a* of the apparatus as it is guided by the guides 30*b* provided on the housing 10*a* of the main body 10. The fifth paper supply cassette 90 is capable of supplying mainly A3 size glossy paper for color copiers including maximum 400 mm long paper.

On the bottom surface of the fifth paper supply cassette 90, a fifth paper supply tray 94 is provided for supporting the leading edge of paper P in the take-out direction by rotating corresponding to a remaining amount of paper P by a driving means (not illustrated). On the side of the fifth paper supply cassette 90 at the position about 200 mm away from the leading edge of paper P in the take-out direction, equivalent to nearly the center of maximum 400 mm long paper, a fifth blowing port 97 that is an opening is formed. Behind this blowing port 97 on the bottom surface of the fifth paper supply cassette 90, an about 15° slope 100 is provided to support the rear portion of a paper P. The slope is inclined in the direction reverse to the tilt of the fifth paper supply try 94.

When sheets of paper P are placed in the fifth paper supply cassette 90 with its bottom surface formed so as to incline both sides of paper P upward to the blowing port 97 as the top, the paper P are bent at the position of the blowing port of the fifth paper supply cassette 90 and adhesion between sheets of paper is made weak. 96*a* shows a width control plate that is able to slide on the slope 100 according to the length of paper. 96*b* is a trailing edge control plate that is able to slide on the slope 100 according to the length of paper.

Air is blown into the fifth blowing port 97 from the fifth blowing mechanism 98 that has a fifth fan 98*a* and a fifth duct 98*b*. This air enters between the bent portions of paper P wherein the adhesion is weakened. On the top surface of the fifth paper supply cassette 90, a cover unit 99 is provided. This cover can be opened/closed at the supporting point 99*a*. A fifth limiting arm 95 is mounted to the cover unit 99 to prevent paper P from excessively rising by rotating with a mounting shaft 95*a* as a supporting point. 95*b* is a stopper.

When the A3 size color image forming operation is started, the fifth fan 98*a* of the fifth blowing mechanism 98 is driven to blow air into the fifth blowing port through the fifth duct 98*b*. The air enters into sheets of paper P within a range regulated by the fifth liming arm 95 in the fifth paper supply cassette 90, adhesion between sheets of paper P is relieved, paper P rises and it becomes easy to separate a paper P on the top position. The air is blown by the fifth blowing mechanism 98 to a portion of a paper P with the adhesion made weak as a result of bending of the paper P and easily enters into sheets of paper P and its strength is adjusted further weaker than the first blowing mechanism 38 so as not to enter into sheets of paper P to the paper supply position by the pickup roller 31.

In such the state, a paper P at the top position in the fifth paper supply cassette 90 is taken out easily by the friction paper supply force of the pickup roller 31, separated easily from the second and subsequent sheets of paper P by the friction separation force of the separation roller 32, sent out in the direction of the first transferring roller 33 and yellow, magenta, cyan and black toner images are multi-transferred sequentially on the paper.

According to this second embodiment, the air is blown into a portion of a paper P with adhesion weakened and therefore, the air easily enters between sheets of paper P by the blowing mechanism 98, adhesion is further reduced and separation of a paper P can be promoted. Further, as the air blown from the fifth blowing mechanism 98 is adjusted not to enter between sheets of paper P at the position of the pickup roller 31, the friction paper supply force by the pickup roller 31 acts on the paper at the top position certainly without escaping. Further, the cover unit 99 covers the paper supply cassette 90 and a P is restricted to rise by the fifth limiting arm 95. Therefore, fluttering of sheets of paper P can be prevented and the satisfactory friction paper supply is obtained without impeding the friction paper supply force of the pickup rollers 31, 41 or preventing a paper P from contacting peripheral devices.

Accordingly, likewise the first embodiment, sheets of paper can be supplied positively without restricting size or kind of paper P used by the paper supply cassette 90 and a high functional and reliable image forming apparatus is obtained.

Further, the present invention is not limited to the embodiments described above but can be varied variously within the scope of the present invention. For example, the blowing mechanism only is not exclusively used but a fan for radiation of the fixing roller or a fan for an ozone filter is also usable. When such fans are also used as blowers, the air is constantly blown between sheets of paper not only when supplying paper but also as long as the main body of an image forming apparatus is being driven. Further, locations of openings or the air strength of the blowing mechanism are optional in a range wherein the air blown from openings does not affect friction paper supply members to take out paper P. Further, the shape and members of the limiting arm are also optional and size and characters of paper supplied are also not restricted.

The structure of an image forming apparatus is also optional and a location of a paper feeder equipped with a blowing mechanism is not limited. In addition, a blowing mechanism may be provided to all paper supply mechanisms that are used in image forming apparatuses. Further, a friction paper supply member also can be a paper supply belt.

As described above in detail, according to the present invention, adhesion of sheets of paper is reduced by the air entering between sheets of paper in the area upstream from the friction paper pickup rollers and supports the friction paper supply force and therefore, sheets of paper in the paper supply cassettes can be supplied easily and certainly. Accordingly, various kinds of paper can be supplied certainly using paper supply cassettes and functions and reliability of an image forming apparatus can be improved.

What is claimed is:

1. A paper feeder comprising:

a paper supply cassette containing sheets of paper;

a friction pickup member in contact with a sheet of paper at a top position of the sheets of paper in the paper supply cassette to take out the sheet of paper in a prescribed direction;

a supporting member provided on a bottom surface of the paper supply cassette to support swingably a leading edge of the sheet of paper in the prescribed direction so that an upstream position from the friction pickup member is used as a supporting point, wherein the sheet of paper is bent at the supporting point; and a blowing mechanism to blow air to the bent portion of the sheet of paper.

2. The paper feeder according to claim 1, wherein the bottom surface of the paper supply cassette at a downstream side from the supporting point is inclined to raise the leading edge of the sheet of paper higher than the supporting point.

3. The paper feeder according to claim 1, wherein the paper supply cassette has a rising limiter configured to contact a top surface of the sheet of paper when the sheet of paper rises above a prescribed height.

4. A paper feeder comprising:

a paper supply cassette containing sheets of paper;

a pickup roller in contact with a sheet of paper at a top position of the sheets of paper in the paper supply cassette to take out the sheet of paper in a prescribed direction;

a paper supply tray provided on a bottom surface of the paper supply cassette to support swingably a leading edge of the sheet of paper in the prescribed direction so that an upstream position from the pickup roller is used as a supporting point, wherein the sheet of paper is bent at the supporting point; and a fan to blow air to the bent portion of the sheet of paper.

5. The paper feeder according to claim 4, wherein the bottom surface of the paper supply cassette at a downstream side from the supporting point is inclined to raise leading edge of the sheet of paper higher than the supporting point.

6. The paper feeder according to claim 4, wherein the paper supply cassette has a limiting arm configured to limit the sheet of paper from rising above a prescribed height by contacting a top surface of the sheet of paper.

7. An image forming apparatus comprising:

a main body a paper supply cassette provided in the main body and containing sheets of paper;

a pickup roller in contact with a sheet of paper at a top position of the sheets of paper in the paper supply cassette to take out the sheet of paper in a prescribed direction;

a paper supply tray provided on a bottom surface of the paper supply cassette to support swingably a leading edge of the sheet of paper in the prescribed direction so that an upstream position from the pickup roller is used as a supporting point, wherein the sheet of paper is bent at the supporting point;

a fan to blow air to the bent portion of the sheet of paper; and an image forming unit provided in the main body to form an image on the sheet of paper taken out by the pickup roller from the paper supply cassette.

8. The image forming apparatus according to claim 7, wherein the paper supply cassette has a limiting arm configured to limit the sheet of paper from rising above a prescribed height by contacting a top surface of the sheet of paper.

9. A paper feeder comprising:

a paper supply cassette configured to house a plurality of sheets of paper;

a friction pickup member configured to be in contact with a sheet of paper at a top position in the paper supply cassette and to remove the sheet of paper in a prescribed direction;

an opening formed in the paper supply cassette for passing air to side portions of the sheets of paper at an upstream position from the friction pickup member;

a blowing mechanism to blow the air into the opening; and a supporting member provided on a bottom surface of the paper supply cassette configured to support a leading edge of the sheet of paper so that an upstream position from the friction pickup roller is used as a supporting point, wherein the sheet of paper is bent at the supporting point, and wherein the bottom surface of the paper supply cassette at a downstream side from the supporting point is inclined to raise leading edge of the sheet of paper higher than the supporting point.

10. A paper feeder comprising:

a paper supply cassette configured to house a plurality of sheets of paper;

a friction pickup member configured to be in contact with a sheet of paper at a top position in the paper supply cassette and to remove the sheet of paper in a prescribed direction;

an opening formed in the paper supply cassette for passing air to side portions of the sheets of paper at an upstream position from the friction pickup member;

a blowing mechanism to blow the air into the opening; and wherein the paper supply cassette has a rising limiter that contacts a top surface of the sheet of paper when the sheet of paper rises above a prescribed height.

* * * * *